US005879515A

United States Patent [19]

Straub et al.

[11] Patent Number: 5,879,515

[45] **Date of Patent: *Mar. 9, 1999**

[54] JET DEVICE

[75] Inventors: Karlheinz Straub, Heidenheim; Wolfgang Schneider, Stuttgart; Hans-Peter Sollinger, Heidenheim; Jürgen Banning, Dueren; Markus Oechsle, Bartholomae, all of Germany

[73] Assignee: Voith Sulzer Papiermaschinen GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 606,646

[22] Filed: Feb. 26, 1996

[30] Foreign Application Priority Data

| | | | |
|---|---|---|---|
| Feb. 24, 1995 | [DE] | Germany | 195 07 938.8 |
| Oct. 19, 1995 | [DE] | Germany | 195 39 015.6 |
| Dec. 22, 1995 | [DE] | Germany | 195 48 302.2 |
| Dec. 29, 1995 | [DE] | Germany | 195 48 893.8 |

[51] Int. Cl.[6] ..... D21F 1/32; B08B 3/02

[52] U.S. Cl. ..... 162/275; 162/286; 162/194; 162/272; 83/98; 134/68; 134/122 R; 239/551

[58] Field of Search ..... 162/193, 194, 162/195, 275, 277, 278, 286, 199, 272; 34/117, 120; 83/22, 24, 53, 98, 177, 402, 428; 134/68, 72, 95.3, 103.2, 129, 144, 151, 167 R, 172, 198, 122 R; 239/104, 105, 106, 103, 108, 109, 452, 456, 548, 551

[56] References Cited

U.S. PATENT DOCUMENTS

| | | | |
|---|---|---|---|
| 2,803,499 | 8/1957 | Goyette et al. | 239/109 |
| 2,954,170 | 9/1960 | Goyette et al. | 239/109 |
| 3,517,578 | 6/1970 | Krofta | 83/177 |
| 3,891,157 | 6/1975 | Justus | 242/56.2 |
| 3,990,637 | 11/1976 | Nicholson | 239/108 |
| 4,087,320 | 5/1978 | Daahy et al. | 162/252 |
| 4,182,170 | 1/1980 | Grupp | 83/177 |
| 4,266,112 | 5/1981 | Niedermeyer | 219/121 N |
| 4,270,702 | 6/1981 | Nicholson | 239/455 |
| 4,270,978 | 6/1981 | Fioravanti | 162/199 |
| 4,573,382 | 3/1986 | Kloehn et al. | 83/53 |
| 4,903,559 | 2/1990 | Landeck | 83/24 |
| 4,931,140 | 6/1990 | Peltola et al. | 162/193 |
| 4,966,059 | 10/1990 | Landeck | 83/53 |
| 5,445,055 | 8/1995 | Koponen et al. | 83/53 |
| 5,595,632 | 1/1997 | Macierewicz | 162/277 |

FOREIGN PATENT DOCUMENTS

| | | | |
|---|---|---|---|
| 0009909 | 4/1980 | European Pat. Off. . | |
| 2424112 | 11/1979 | France . | |
| 3841160 | 6/1989 | Germany . | |
| 2048977 | 12/1980 | United Kingdom . | |
| 91 03359 | 3/1991 | WIPO . | |
| 94/14584 | 7/1994 | WIPO | 83/177 |

OTHER PUBLICATIONS

*Patent Abstracts of Japan,* vol. 18, No. 615 (C–1277), 24 Nov. 1994 & JP–A–06 235180, Aug. 23, 1994.

*Primary Examiner*—Donald E. Czaja
*Assistant Examiner*—Jose A. Fortuna
*Attorney, Agent, or Firm*—Ostrolenk, Faber, Gerb & Soffen, LLP

[57] ABSTRACT

The invention proposes a jet device for a machine for producing a material web, in particular a paper or board web, having a nozzle device for dispensing a jet of liquid which is under pressure and is directed onto the material web and/or a transport belt guiding the material web. A changeover device by which the pressure with which the medium impinges on the transport belt or the material web, respectively, can be set.

14 Claims, 4 Drawing Sheets

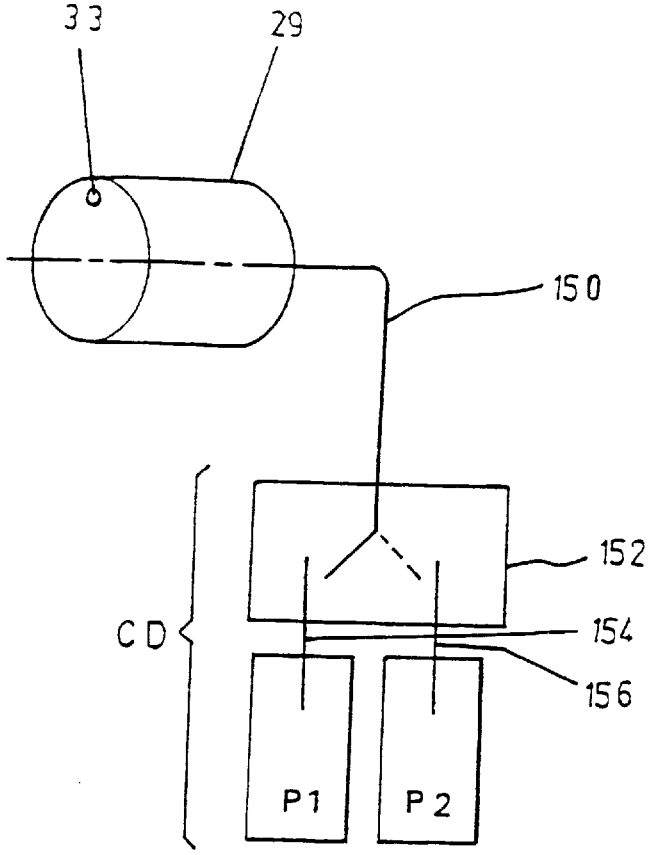
Fig. 6
Fig. 7
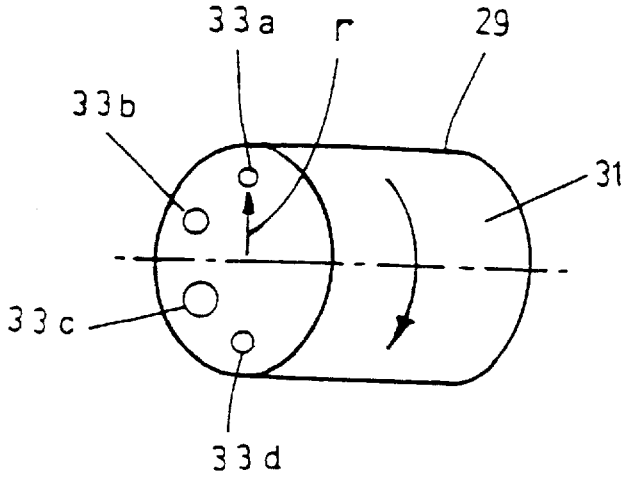

JET DEVICE

BACKGROUND OF THE INVENTION

The invention relates to a jet device for a machine for producing a web, in particular a paper or board web.

In papermaking machines, numerous transport belts, particularly fabric belts, are used. These become dirty during operation of the machine. Meshes or pores of the belts become clogged, for example, by paper fibers, adhesives or deposits. In order to ensure that the transport belt functions satisfactorily, in particular a belt in the drying section of a papermaking machine, the transport belt must be cleaned. A jet device for this purpose and designed as a cleaning device is known from German Utility Model G 9208909.7 U1. This document discloses the concept of providing jet nozzles which can be moved transversely in relation to the running direction of the transport belt and which clean the transport belt by spraying liquid on it.

In addition, tail cutters are known of the type which apply a jet to a material web that is moving on a transport belt within a papermaking machine. The jet severs a strip of the material web, in particular a threading strip or tail, and that strip is guided through the papermaking machine to thread the entire material web.

There are large space requirements within a paper machine due to the use of cleaning devices and tail cutters, and in many cases a complicated construction results.

SUMMARY OF THE INVENTION

It is therefore the object of the invention to provide a jet device for a machine for producing a web, in particular a paper or board web, which does not have these disadvantages.

To achieve this object, a jet device according to the invention comprises a changeover device which changes the pressure at which liquid is sprayed from the jet depending upon the use being made of the jet device, i.e. as a tail cutter or a cleaning device, and the pressure needed for each of these without damaging the transport belt. Because the jet device is provided with a changeover device, which can set the pressure with which the sprayed liquid medium impinges on the transport belt, both the pressure required for severing a material web guided on the transport belt and the pressure needed for cleaning the transport belt may be provided. The available pressure differential ensures that the belt is not damaged during cleaning.

In a particularly preferred embodiment of the jet device, the changeover device acts on a supply device which supplies the medium to a nozzle device. The construction outlay which is necessary for installation and use of the jet device may be reduced to a minimum, so that the additional space requirement and the costs for the changeover device are minimal.

In various embodiments, there may be more than one supply line for liquid medium to the nozzle device and the changeover device acts on at least one of them. The nozzle device may include at least two nozzles of different opening sizes or diameters with which the changeover device cooperates to change the pressure. To distribute the jet and minimize damage to the belt, the nozzle carrier may be rotatable and/or it may be traversable across the web.

The object of the invention is also achieved because a tail cutter is used as a device for cleaning a transport belt of a papermaking machine or a cleaning device is used as the tail cutter avoiding need for two different devices in the same machine. In both cases, a changeover device is provided with which the pressure at which the medium impinges on the transport belt or the material web, respectively, can be set.

Other objects and features of the invention are explained below with reference to the drawings.

BRIEF DESCRIPTION OF THE DRAWINGS

FIG. 6 shows a changeover device for obtaining different nozzle functions; and FIG. 7 shows a nozzle with several, differently sized nozzle openings.

DETAILED DESCRIPTION OF THE INVENTION

Jet devices are known which can direct a liquid jet onto a transport belt or onto a material web guided by the belt. Such a device is called a tail cutter or a cleaning device. FIGS. 1 to 4 show an example of a tail cutter, while FIG. 5 shows a cleaning device.

Figure 1:
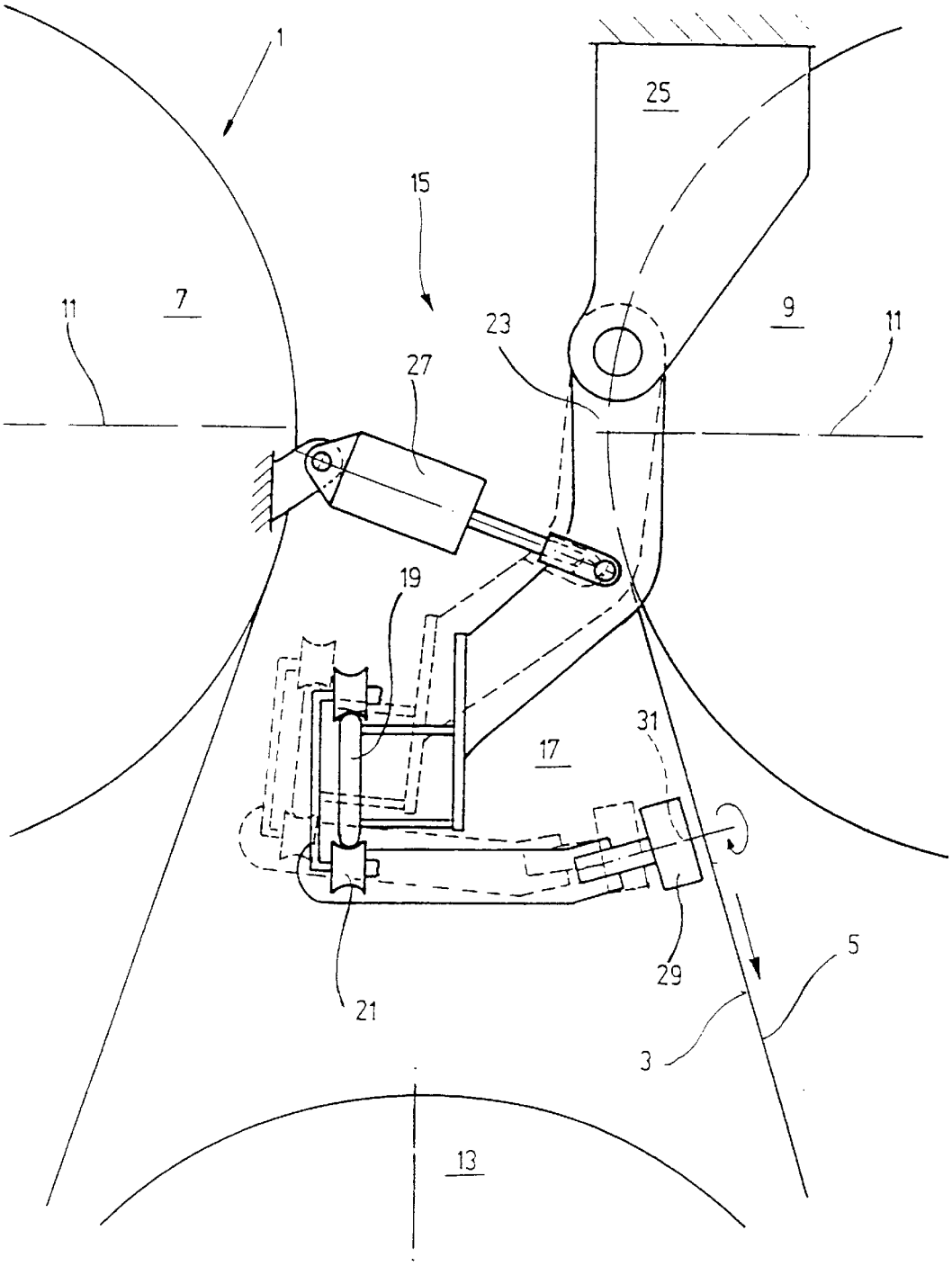
FIG. 1 shows a basic schematic of a tail cutter.

FIG. 1 shows a detail of the tail cutter zone of a machine 1 for producing a paper web. The following text, as an example, shows a papermaking machine which has a number of rolls around which the web to be produced, namely the paper web 3, is guided with the aid of a transport belt, particularly a drying fabric or felt 5. Two drying cylinders 7 and 9 are shown as examples. Their central axes are in imaginary plane 11. A further roll, for example a web guide roll or another drying cylinder, is indicated below the plane 11.

A jet device is disposed between the drying cylinders 7 and 9. It is designed as a tail cutter 15. It includes a nozzle device 17, which directs a liquid jet, not illustrated, onto the surface of the rapidly moving paper web 3, which moves in the web conveying direction indicated by an arrow. The nozzle device 17 is fastened on a carrying beam 19 which extends transversely to the conveying direction of the web 3. A suitable roller device 21 mounts the nozzle device 17 on the beam 19 so that the nozzle can be displaced transversely in relation to the conveying direction of the web 3. The carrying beam 19 is supported to swing to different positions via a carrying arm 23, which is pivoted on a bearing 25. The arm 23 is pivoted by a suitable device comprising, for example, a hydraulic or pneumatic cylinder device 27 connected between a stationary support and the arm 23. The operating position of the tail cutter 15 is represented in FIG. 1 using continuous lines. The retracted rest position of the tail cutter 15, where it is pivoted away from the web surface, is illustrated using dashed lines.

The nozzle device 17 comprises a nozzle carrier or support 29, which has an individual nozzle, not represented here, which directs liquid onto the web 3 under high pressure. During operation of the tail cutter 15, the movably mounted nozzle carrier 29 itself moves relative to the nozzle device 17. In the impingement area of the liquid jet on the web 3, this produces a cutting line which does not extend in a straight line but instead has a wave shape. This is due to the superimposition of the conveying movement of the web 3 and the relative movement of the nozzle carrier 29 in relation to the nozzle device 17. The conveying speed of the web 3 or of the drying fabric 5, respectively, is also designated as machine speed v.

In the exemplary embodiment shown, an arrow curved in a circular arc indicates that the nozzle carrier 29 performs rotational movement about a rotation axis 31 in relation to the nozzle device 17. As a result, an individual nozzle 33 which is fastened on the nozzle carrier 29 follows a circular path eccentric to and at a distance from the axis of rotation 31 as shown with nozzle 33 in FIG. 2.

Figure 2:
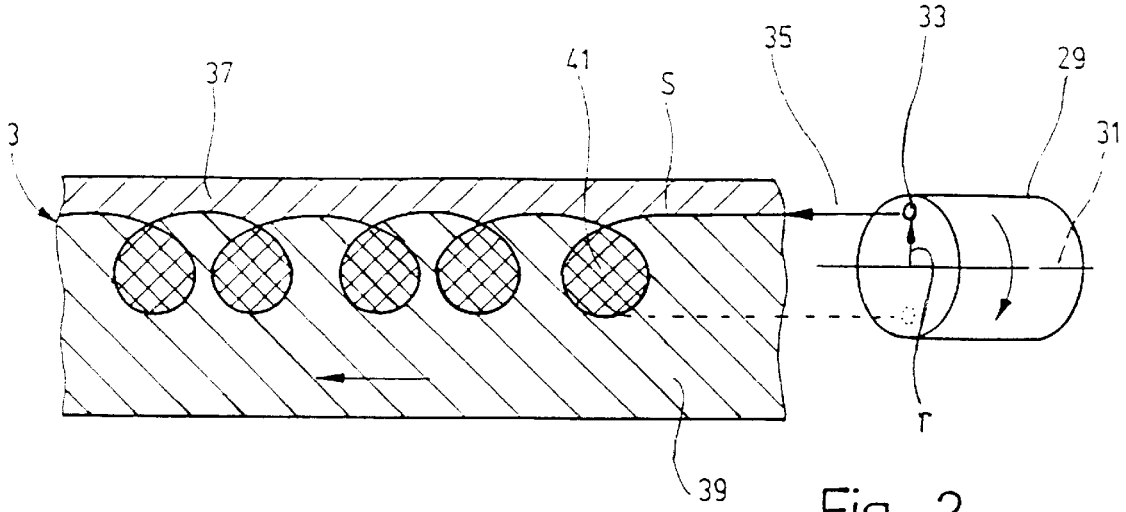
FIGS. 2 to 4 show various cutting lines across a web which can be produced using the tail cutter according to FIG. 1.
Figure 3:
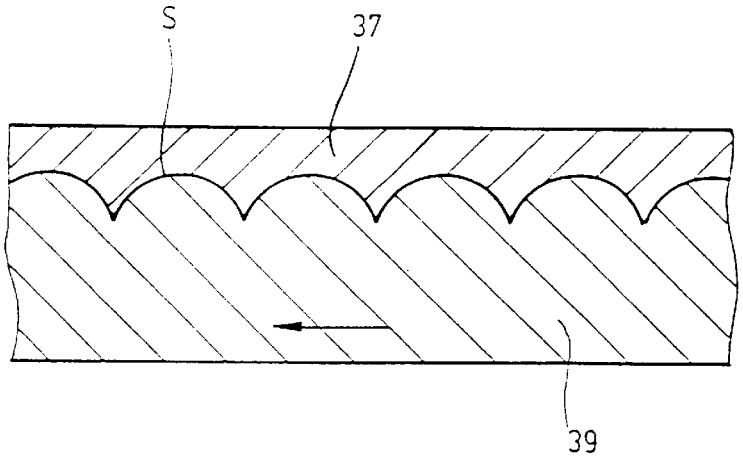
Figure 4:
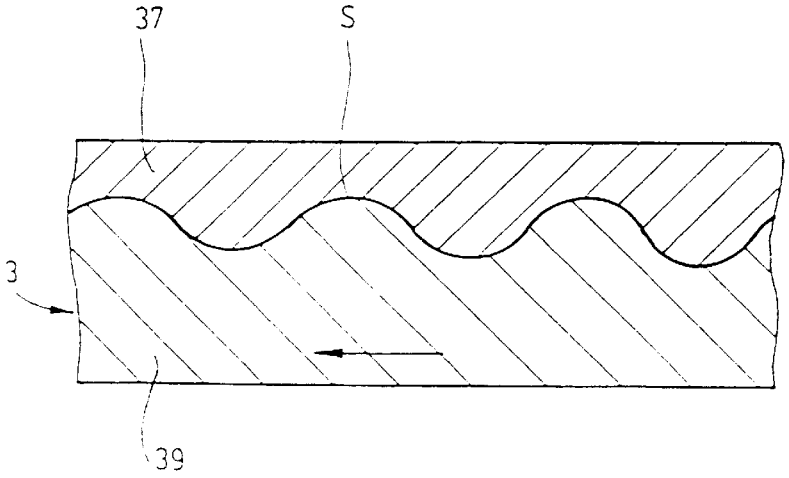
Figure 5:
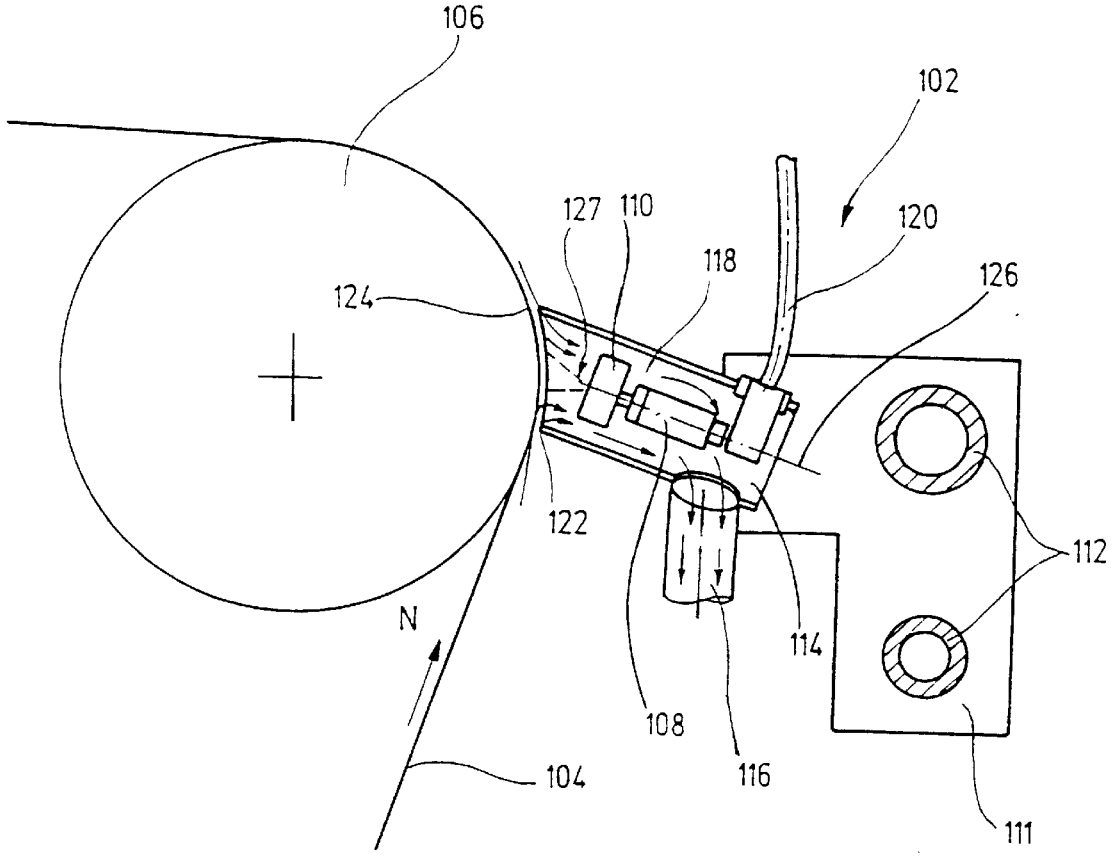
FIG. 5 shows a basic schematic side view of a cleaning device.

FIGS. 2 to 4 show cutting lines which can be produced using a tail cutter 15 with a rotating nozzle carrier 29, when the carrier is equipped with a single individual nozzle 33, as indicated in FIG. 2. FIG. 2 shows the edge region of the web 3 which, as indicated by an arrow, is guided past the rotating nozzle carrier 29. The liquid jet 35 from the nozzle 33 impinges on the surface of the web 3 and produces a cutting line which encloses closed loops and has approximately the shape of a cycloid. The transfer strip or tail 37, which is to be threaded through the machine 1 after a web break or when the machine for producing a paper web is being started up, is located above the cutting line. The rest of the web is located below the cutting line and it is later fed to reprocessing after it is discharged, for example, into the basement. The paper regions 41 located inside the closed loops form waste web which are possibly guided, in an uncontrolled manner along with the drying fabric 5, through the papermaking machine.

The rotational speed of the nozzle carrier 29 is preferably matched to the machine speed or web conveying speed v in such a way that the path traced by the web 3 in the arrow direction during one revolution of the nozzle 33 is at least twice the radial distance r of the individual nozzle 33 from the axis of rotation 31.

The cutting line S illustrated in FIG. 2 shows an operational case in which the rotational speed of the nozzle carrier 29 is so low that the path s traced by the web 3 is less than twice the distance r of the individual nozzle 33 from the axis of rotation 31.

FIG. 3 shows the limiting case in which the machine speed v is precisely high enough that the path s traced by the web 3 during the time t is equal to twice the distance r.

In FIG. 3, the cutting line S has the approximate form of a cycloid but does not have any closed loops. The transfer strip 37 is therefore severed from the rest of the paper web 39 without waste like areas 41.

The limiting speed given for this case may be determined from the equation $v=2\times r\times n$, where n designates the rotational speed of the nozzle carrier 29.

If the distance r of the individual nozzle 33 from the axis of rotation 31 is, for example, 25 mm, and if n=2000/min is set for the rotational speed of the nozzle carrier 29, then the machine speed v must be $\geqq 100$ m/min. Optimal separation between the transfer strip 37 and the rest of the paper web 39 is achieved when the machine speed v is greater than the limiting speed defined here, which is readily possible for the numeric example shown here, in particular with papermaking machines which reach machine speeds of more than 1600 meter/min.

An optimal cutting line S is represented in FIG. 4 as there are no closed loops, no sharp points, but only a gradually changing wave form.

The foregoing shows that the nozzle carrier 29 can also perform an oscillating motion in relation to the nozzle device 17. In such motions, the individual nozzle 33 executes an oscillating movement in relation to the web 3. This movement is carried out approximately on a line which extends transversely in relation to the conveying direction of the web 3.

The nozzle carrier 29 may alternatively execute a gyratory movement in relation to the nozzle device 17. In addition to the oscillating motion described, there is a component of motion in which the nozzle carrier moves alternately in the conveying direction and counter to the conveying direction of the web 3, i.e., to the left and right in FIG. 2.

It is important in every case that the to and fro movement of the individual nozzle 33 or of the nozzle carrier 29, respectively, be matched to the machine speed so that the cutting line S produces no closed loops, as was explained with reference to FIG. 2.

In FIG. 1, the tail cutter 15 dispenses a liquid jet onto a region of the web which is located between two rolls, here between the drying cylinder 9 and the web guide roll 13. The liquid jet 35 tears through the paper web 3 and passes through the drying fabric 5. Fiber particles and other particles which are torn out from the paper web by the jet are carried through the drying fabric by the liquid jet 35. The mechanical loading of the drying fabric is reduced to a minimum, since the non-linear path of the jet along and partially traversing to and fro across the web and the fabric avoids the same widthwise region of the circulating, continuous drying fabric being constantly struck by the liquid jet. This is ensured by the cutting line running more or less in a wave shape along the transition region between the transfer strip 37 and the rest of the paper web 39.

In order to reduce the mechanical loading of the drying fabric 5 to a minimum, while simultaneously ensuring optimal cutting power of the tail cutter 15, a liquid jet 35 that impinges on the web 3 supported by the drying fabric 5, is produced at a pressure of 100 bar to 800 bar, preferably of 200 bar to 500 bar. It has been shown that precisely in a pressure range of 200 bar to 500 bar, reliable separation between the transfer strip 37 and the rest of the web 39 is achieved and damage to the drying fabric 5 can be virtually excluded, at least if the machine is running, that is to say the drying fabric is moving, and if the nozzle carrier is rotating.

Deviating from what is shown in FIG. 1, it is also possible to arrange the tail cutter 15 such that it acts on the web 3 where the web is resting on a roll, either a drying cylinder 7 or 9 or a web guide roll 13. Here, the pressure under which the liquid jet 35 emerges from the individual nozzle 36 can lie in a range of 100 bar to 2000 bar, and a pressure of 500 bar to 1500 bar is preferable.

The tail cutter 15 is preferably designed such that the pressure at which the liquid jet 35 emerges from the individual nozzle 33 can be set as a function of the point of impingement of the jet on the web 3 and as a function of the basis weight of the web material. This ensures that the tail cutter 15 can be universally employed.

Finally, the wave-shaped course of the cutting line S reduces the contamination of the drying fabric 5 or of the surface of the rolls 7, 9 or 13 to a minimum. In addition, the mechanical and erosive loading of the parts which are struck by the jet is significantly reduced. The relative movement of the nozzle carrier produces high cutting power and causes a favorable cleaning action of the liquid jet.

FIG. 5 shows an embodiment of a jet device which is designed as a cleaning device 102 and is arranged in the region of a roll 106 of a paper machine, not illustrated. The jet device is used for the purpose of cleaning a drying fabric belt, e.g., a drying fabric 104. The cleaning device 102 can be used for any desired transport belts of a paper or boardmaking machine, for example for wires or felts of a wire section, a press section or a drying section of a paper machine. The following text assumes drying fabric belts of a paper machine, by way of example. The cleaning device 102 comprises a rotary nozzle, here cleaning nozzle 108, which has a rotating nozzle head 110. The head has a nozzle arrangement, which is not illustrated. The nozzle arrangement can comprise one or more driving nozzles, with tangential outflow, for producing a rotational movement in the range from 2000 to 3000 revolutions per minute, as well as one or more cleaning nozzles, which are directed at the drying fabric and apply a cleaning medium to the drying fabric 104.

In addition, for example, a cylindrical shape suction bell 114 surrounds the cleaning nozzle 108 and the nozzle head 110. The interior of the suction bell 114 is connected in terms of flow to a suction line 116, and thereby forms suction space 118 that is associated with the cleaning nozzle 108. The suction bell can also be of oval cross section. The nozzle head 110 is also able to be arranged eccentrically.

The cleaning device 102 comprises a power chain for the supply of cleaning medium. Only a high pressure hose 120 at the end of that chain is shown. The hose can be connected to a high pressure pump, for supplying the cleaning nozzle 108 with liquid in a pressure range from 100 bar to 1000 bar, preferably from 100 bar to 400 bar, and particularly from 150 bar to 300 bar. The suction line 116 carries spray water or water mist with dirt particles therein away from the suction space 118.

The components of the cleaning device 102 which have been described are arranged on a traversing carriage 111 by which they can be displaced along a direction transverse to the running direction of the drying fabric 104. The traversing carriage 111 is seated on transverse beams 112 and the carriage can be driven along the beams by a traversing motor, not illustrated, at a predeterminable speed. The traversing speed normally lies in the region of about 0.3 m/min.

As can be seen from FIG. 5, an end region 122, of the suction bell 114 which faces the drying fabric 104 is matched to the circular circumferential shape of the roll 106, so that a specific adjustable distance or gap between the suction bell 114 and the drying fabric 104 is ensured. That gap is essentially constant along the edge 124 of the end region 122.

Arranging the cleaning device in the region of the roll 106 has the following advantage. The meshes of the transport fabric 104 are widened by deflection of the fabric on the roll. As a result, the cleaning medium can penetrate particularly easily into the fabric formation of the transport fabric and can remove contaminants very effectively.

During operation of the cleaning device 102, the cleaning nozzle 108 or the nozzle arrangement in the nozzle head 110 has a cleaning medium, preferably water under high pressure, applied to it via the high pressure hose 120. The nozzle head 110 with the arrangement of individual nozzles is set into rotation caused by the reaction effect of driving nozzles. This causes the liquid jet to describe a conical path 127 extending at a specific angle in relation to the nozzle longitudinal axis 126 of the cleaning nozzle. It therefore impinges on the drying fabric 104 at an angle and thus detaches contaminants from its surface.

It is also possible to equip the nozzle head 110 with one or more pivotally mounted individual nozzles which perform an oscillating motion and which, during the traversing movement of the nozzle head 110, sweep over a strip shaped region of the drying fabric 104.

The superimposition of the traversing movement and the rotational or pivoting movement causes the dirt particles to be struck from various directions by the liquid jet from the nozzle arrangement. As a result, the dirt can be more easily detached than when using a nozzle that extends parallel to the central axis 126. Inclination of the nozzle head 110 or of the nozzle arrangement causes the liquid jet which impinges on the drying fabric belt to be reflected into the suction space 118 this enables the water mist which is produced in the process, together with dirt particles bound therein and residual water, to be carried away via the suction line 116. The result is a suction effect, or flow, indicated by the arrows. Furthermore, no spray water occurs around the outside of the suction bell 114, and the emergence of dirt or water can also be avoided to the greatest possible extent.

It is particularly advantageous if the reduced pressure in the suction space 118 and in the suction line 116 is produced by a compressed air injector. It is also advantageous for the reduced pressure in the suction space 118 to be variable so that it can be matched to different operating conditions.

The cleaning nozzle 108 or the individual nozzles in the nozzle head 110 are designed for spraying water at a pressure range of 100 bar to 1000 bar, and preferably of 100 bar to 400 bar, and have a nozzle diameter of 0.1 to 0.8 mm, and preferably of 0.2 mm to 0.4 mm. Pressure values of 150 bar to 300 bar and nozzle diameters of 0.2 mm to 0.4 mm have proved to be particularly worthwhile. Diamond or ruby, or preferably sapphire or ceramic materials, are used as the nozzle material. They are less likely to be eroded.

The cleaning device 102 is preferably arranged so that the cleaning medium impinges on a region of the transport fabric 104 which is arranged very close to the surface of the deflection roll. This ensures that the transport fabric is deformed only slightly when the cleaning medium impinges on it, producing only a very small energy loss. The cleaning device can also be arranged in the region of the ingoing nip N between the fabric and the roll 106. The over-pressure that is developed in the region of the ingoing nip N can then assist the suction effect of the suction space 118. This causes the detached particles to be carried away from the surface of the transport fabric particularly effectively and at the most only very little of the cleaning medium emerges from the suction space.

By using the cleaning device described here, transport belts of a paper machine can be cleaned very thoroughly, that is, troublesome particles are carried away very effectively from the transport belt surface by the nozzle head. As a result of the high pressure of the medium emerging from the nozzles, the particles are virtually peeled off from the belt or fabric surface. Because of the relatively small diameters of the openings in the nozzles, the quantity of water or liquid medium required remains relatively small, which limits the swirling up of the dirt. The energy, which is otherwise necessary for building up the high pressure, can be reduced for specific contaminants, specifically if the dirt particles are not pressed into the transport belt surface by a broad liquid jet. In these cases, liquid can be applied at a low pressure or in great quantities to the belt surface in order to wash away dirt particles.

Finally, it is also possible to adapt the liquid medium selected to the particular transport belts or to their contamination, for example, if appropriate, even to use readily volatile liquids, so that rewetting of the paper web by the cleaned belt or fabric is avoided.

Furthermore, the foregoing shows that the impingement direction of the cleaning medium is decisive for effecting the cleaning of the transport belt surface. A change in the direction of the cleaning flow is also very advantageous for loosening dirt particles. This can be achieved using oscillating nozzles. It is important that this cleaning effect can, if required, also be carried out without traversing by the cleaning device. In this case, a plurality of cleaning or nozzle heads is distributed over the width of the transport belt to be cleaned with each of the heads being provided with at least one or more individual nozzles.

Finally, the cleaning effect can be varied by changing the distance between the nozzle and the transport belt or fabric surface, by changing the pressure of the cleaning medium and/or by changing the nozzle cross section, and each of these can be matched to various types of contamination and transport belt surfaces.

The jet devices illustrated in FIGS. 1 to 4 and 5 share in common the fact that provision is made for a changeover device, not illustrated in FIGS. 1 to 4, by which the pressure with which the medium that emerges from the jet device and impinges on the transport belt or on the material web, respectively, can be set. As a result of the changeover, it is possible to use the jet device both as a tail cutter and as a cleaning device. Depending upon the individual nozzle used, the pressure which is necessary for use of the jet device as a tail cutter is about 200 bar to 300 bar lower than is necessary for its use as a cleaning device. To ensure that the jet device can be employed for a wide range of applications, the changeover device can effect a pressure difference of 100 bar to 600 bar.

It is possible to assign the changeover device to a supply line via which liquid is fed to one or more nozzles of the jet device. The pressure prevailing in the supply line can be varied using the changeover device and can thus be matched to the use of the jet device.

The jet device may have a plurality of nozzles, and at least two individual nozzles, each having respective different diameters, which cooperate with the changeover device. Using the changeover device at a constant supply pressure, the individual nozzle having the smaller diameter can have liquid applied to it if the jet device is to be used as a tail cutter. In a corresponding manner, the individual nozzle having the greater diameter can have the supply pressure applied to it if the jet device is to serve as a cleaning device, that is if the liquid jet is intended to impinge on the transport belt at a lower pressure.

It becomes clear that the changeover device described here can be used as a tail cutter and it can also be used as a cleaning device, and that a cleaning device can also be used as a tail cutter. It is thus no longer necessary to provide different jet devices in order, on the one hand, to cut a material web within a paper machine and, on the other hand, to ensure cleaning of a transport belt. The space requirement within the paper machine is thereby significantly reduced. The production and maintenance costs may also be reduced considerably.

In addition, from the description relating to FIGS. 1 to 5, it becomes clear that the jet device can also have various nozzles, which are used, on the one hand, for fabric cleaning and, on the other hand, for cutting a material web. In this arrangement, a respective separate pressure supply can also be provided, which is associated with either the cleaning or the cutting nozzles. The changeover device then is designed such that in each case, it activates the corresponding pressure supply for the cleaning or cutting nozzles, respectively, so that the jet device can be sometimes used as a cleaning device and sometimes as a cutting device. In any case, there is a compact construction if the changeover device, as described above, is associated with the supply line or nozzles and if only one single pressure supply is provided for all the nozzles of the jet device. The number of supply devices and of changeover devices depends, in the final analysis, on the construction of the papermaking machine. In some cases, it may be advantageous to provide a plurality of pressure supply devices over the length of the papermaking machine, wherein each device is combined with a changeover device.

In FIG. 6, the nozzle carrier 29 which is equipped with the individual nozzle 33 is shown connected via a liquid tube 150 to a switching device 152. The switching device 152 is in turn connected via a first line 154 and a second line 156 to a first pump P1 and a second pump P2, respectively. The switching device 152 has the means to connect the line 150 to either one of the lines 154 or 156, based on a selection condition transmitted to the device 152. The pump P1 delivers liquid at a higher pressure than the pump P2. Depending on the state of the switching device 152, the liquid pressure delivered via the tube 150 to the nozzle carrier 29 and to the nozzle 33 can be adjusted high or low to suit different purposes, e.g. cutting a tail or cleaning a fabric, as described above. The switching device 152 and pumps P1 and P2 constitute an exemplary embodiment of the aforementioned changeover device.

FIG. 7 shows a nozzle carrier 29 which contains a number of nozzles 33*a*, 33*b*, 33*c*, 33*d*, etc. of different sizes to accommodate different functions. In this case, a switching device, similar to the switching device 152 of FIG. 6, may be incorporated within the nozzle carrier 29 to connect the source of liquid to any of the nozzles 33*a*, 33*b*, etc.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A papermaking machine in combination with a jet device, the papermaking machine serving to produce a web of paper and for moving that web of paper on a transport belt past a plurality of dryers and the jet device, the jet device comprising:

a nozzle device for dispensing a liquid jet under pressure and for directing the jet onto the web and/or the transport belt which guides the web past the jet device;

the web of paper requiring at times to be cut to form a tail and the transport belt requiring at times to be cleansed of debris which has adhered thereto;

a changeover device connected with the nozzle device and selectively operable as either a tail cutter or as a transport belt cleansing device and further operable for setting the pressure at which the nozzle device sprays a liquid jet on the web of paper or the transport belt being moved past the liquid jet being sprayed by the jet device, the papermaking machine including solely the nozzle device to selectively serve as with the tail cutter or the transport belt cleansing device and lacking separate instrumentalities for cleansing the transport belt and for cutting the paper tail.

2. The papermaking machine of claim 1, further including a first source of pressurized fluid acting through a first line and a second source of pressurized fluid acting through a second line and the changeover device being connectable the first source for enabling the nozzle device to act as the tail cutter and being connectable to the second pressurized source to enable the nozzle device to act as the transport belt cleansing device.

3. The papermaking machine of claim 1, wherein the nozzle device further includes a suction bell which has an interior and a vacuum suction line connected to the interior of the suction bell.

4. The jet device of claim 1, wherein the changeover device effects a pressure difference of between 100 bar to 600 bar.

5. The jet device of claim 1, wherein the changeover device effects a pressure difference of between 200 bar to 300 bar.

6. A jet device in a machine for producing a web of material and for moving that web of material on a transport belt past the jet device, the jet device comprising:

a nozzle device for dispensing a liquid jet under pressure and for directing the jet onto the material web and/or the transport belt which guides the material web past the jet device;

a changeover device connected with the nozzle device and selectively operable for setting the pressure at which the nozzle device sprays a liquid jet on the material web or the transport belt being moved past the liquid jet being sprayed by the jet device, wherein the liquid medium is supplied to the liquid jet through at least one supply line and the changeover device acts on the at least one supply line for selectively adjusting the liquid pressure to a first pressure range suitable for cutting a tail and selectively to a second, different pressure range suitable for cleansing the transport belt.

7. A jet device as in claim 6, further including:

a nozzle carrier for the nozzle device, the web having associated therewith a moving direction which extends along a straight line; and a control device for the jet device to cause the cutting line to have a wave shape relative to the straight line, said control device operatively connected to said jet device.

8. The jet device of claim 7, wherein the control device is a device which rotates the nozzle.

9. A jet device as in claim 6, further including:

a stationary base and a nozzle holder for the nozzle device, said nozzle holder being movable relative to the stationary base.

10. The jet device of claim 9, in which the nozzle holder rotates around an axis of rotation and including a liquid outlet nozzle located at a predetermined distance (r) from the axis of rotation.

11. The jet device of claim 10, in which the nozzle holder rotates at a predeterminable rotational speed and the paper web moves relative to the nozzle assembly at a predetermined paper speed such that the web travels a distance (s) that is at least twice as large as the distance (r) during one rotation of the nozzle holder.

12. A jet device in a machine for producing a web of material and for moving that web of material on a transport belt past the jet device, the jet device comprising:

a nozzle device for dispensing a liquid jet under pressure and for directing the jet onto the material web and/or the transport belt which guides the material web past the jet device;

a changeover device connected with the nozzle device and selectively operable for setting the pressure at which the nozzle device sprays a liquid jet on the material web or the transport belt being moved past the liquid jet being sprayed by the jet device, wherein the nozzle device includes at least two individual nozzles for spraying a liquid jet at the web or the transport belt at different pressure levels, including at a first pressure level range suitable for cutting a tail and at a second, different pressure level range suitable for cleansing the transport belt.

13. The jet device of claim 12, wherein the at least two individual nozzles have different nozzle diameters for spraying liquid at different respective pressures on the web or the transport belt moving past the two nozzles and the changeover device selects to which nozzzle the liquid jet is supplied.

14. The jet device of claim 12, wherein the nozzle device includes a nozzle head having nozzles therein which spray the jet of liquid, and the nozzle head being rotatable around an axis, and the nozzles being so positioned on the nozzle head as to be spaced away from the axis.

* * * * *